US009484622B2

(12) United States Patent
Tai

(10) Patent No.: US 9,484,622 B2
(45) Date of Patent: Nov. 1, 2016

(54) MULTI-BAND ANTENNA

(71) Applicant: HON HAI PRECISION INDUSTRY CO., LTD., New Taipei (TW)

(72) Inventor: Lung-Sheng Tai, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 214 days.

(21) Appl. No.: 14/073,884

(22) Filed: Nov. 7, 2013

(65) Prior Publication Data

US 2014/0125527 A1 May 8, 2014

(30) Foreign Application Priority Data

Nov. 7, 2012 (TW) ..... 101141447 A

(51) Int. Cl.

| | |
|---|---|
| ***H01Q 1/30*** | (2006.01) |
| ***H01Q 9/42*** | (2006.01) |
| ***H01Q 1/24*** | (2006.01) |
| ***H01Q 1/48*** | (2006.01) |
| ***H01Q 5/364*** | (2015.01) |

(52) U.S. Cl.

CPC ..... *H01Q 1/243* (2013.01); *H01Q 1/48* (2013.01); *H01Q 5/364* (2015.01); *H01Q 9/42* (2013.01)

(58) Field of Classification Search

CPC ..... H01Q 9/04; H01Q 1/243; H01Q 9/42; H01Q 5/364; H01Q 21/30

USPC ..... 343/702, 770, 767, 700 MS, 846

See application file for complete search history.

(56) References Cited

U.S. PATENT DOCUMENTS

| | | | | |
|---|---|---|---|---|
| 7,274,297 | B2 * | 9/2007 | Kodukula et al. | 340/572.7 |
| 7,362,277 | B2 * | 4/2008 | Su | H01Q 1/243 343/700 MS |
| 7,642,967 | B2 * | 1/2010 | Wang | H01Q 1/243 343/702 |
| 7,903,036 | B2 * | 3/2011 | Takaki | H01Q 9/42 343/700 MS |
| 8,035,566 | B2 * | 10/2011 | Tsai | H01Q 1/243 343/700 MS |
| 8,054,231 | B2 * | 11/2011 | Ahn et al. | 343/702 |
| 8,144,062 | B2 * | 3/2012 | Ke | H01Q 1/36 343/700 MS |
| 2007/0120753 | A1 * | 5/2007 | Hung | H01Q 1/243 343/702 |
| 2009/0066583 | A1 * | 3/2009 | Hung | H01Q 9/0407 343/700 MS |
| 2009/0256779 | A1 * | 10/2009 | Wang | H01Q 1/2266 343/893 |
| 2010/0194652 | A1 * | 8/2010 | Chiang | H01Q 9/04 343/745 |
| 2011/0094666 | A1 * | 4/2011 | Sun | B29C 45/14 156/245 |
| 2011/0122042 | A1 * | 5/2011 | Huang | H01Q 1/243 343/860 |
| 2012/0169555 | A1 * | 7/2012 | Tsou | H01Q 5/364 343/749 |
| 2012/0262342 | A1 * | 10/2012 | Lee | H01Q 5/35 343/700 MS |

FOREIGN PATENT DOCUMENTS

| | | |
|---|---|---|
| CN | 202405415 | * 12/2011 |
| CN | 202405415 | 8/2012 |
| CN | 202423539 | 9/2012 |

* cited by examiner

*Primary Examiner* — Dameon E Levi
*Assistant Examiner* — Awat Salih
(74) *Attorney, Agent, or Firm* — Wei Te Chung; Ming Chieh Chang

(57) ABSTRACT

An multi-band antenna includes a base section including a first end and a second end opposite to each other, a first radiating arm and a second radiating arm extending opposite to each other from the first end and locating on two opposite sides of the base section in a longitudinal direction, and a loop conductive portion extending from the base section. The loop conductive portion includes a grounding portion locating adjacent to the second end of the base section and a connecting portion extending in the longitudinal direction. The connecting portion is located on the same side of the base section with the first radiating arm.

12 Claims, 4 Drawing Sheets

MULTI-BAND ANTENNA

BACKGROUND OF THE INVENTION

1. Field of the Invention

The present disclosure relates to a multi-band antenna, and more particularly to a multi-band antenna covering a broader frequency band.

2. Description of Related Art

Long Term Evolution (LTE) is an advanced technology in wireless communication for portable electronic devices and other data terminals. The LTE provides downlink rates of 100 Mbit/s, uplink rates of 50 Mbit/s on frequency band of 20 MHz which will be of great benefit to the wireless communication services. The frequency band of 3G is 824~960 MHz and 1710~2170 MHz while the LTE is 704~960 MHz and 1710~2700 MHz which covers the frequency band of 3G. The LTE is better than the 3G wireless communication. Thus, it is necessary to provide an antenna that can satisfy the standard of the LTE.

In view of the above, an improved antenna is desired to overcome the problems mentioned above.

SUMMARY OF THE INVENTION

Accordingly, an object of the present disclosure is to provide an antenna which is capable of covering a broader band.

According to one aspect of the present disclosure, a multi-band antenna capable of meeting the requirements of both 3G and LTE is provided. The multi-band antenna comprising: a base section comprising a first end and a second end opposite to each other; a first radiating arm and a second radiating arm extending opposite to each other from the first end and locating on two opposite sides of the base section in a longitudinal direction; and a loop conductive portion extending from the base section, the loop conductive portion comprising a grounding portion locating adjacent to the second end of the base section and a connecting portion extending in the longitudinal direction, the connecting portion locating on the same side of the base section with the first radiating arm and defining a main matching slot thereon.

Other objects, advantages and novel features of the disclosure will become more apparent from the following detailed description when taken in conjunction with the accompanying drawings, in which:

DETAILED DESCRIPTION OF THE INVENTION

Reference will now be made to the drawings to describe a preferred embodiment of the present disclosure in detail.

Figure 1:
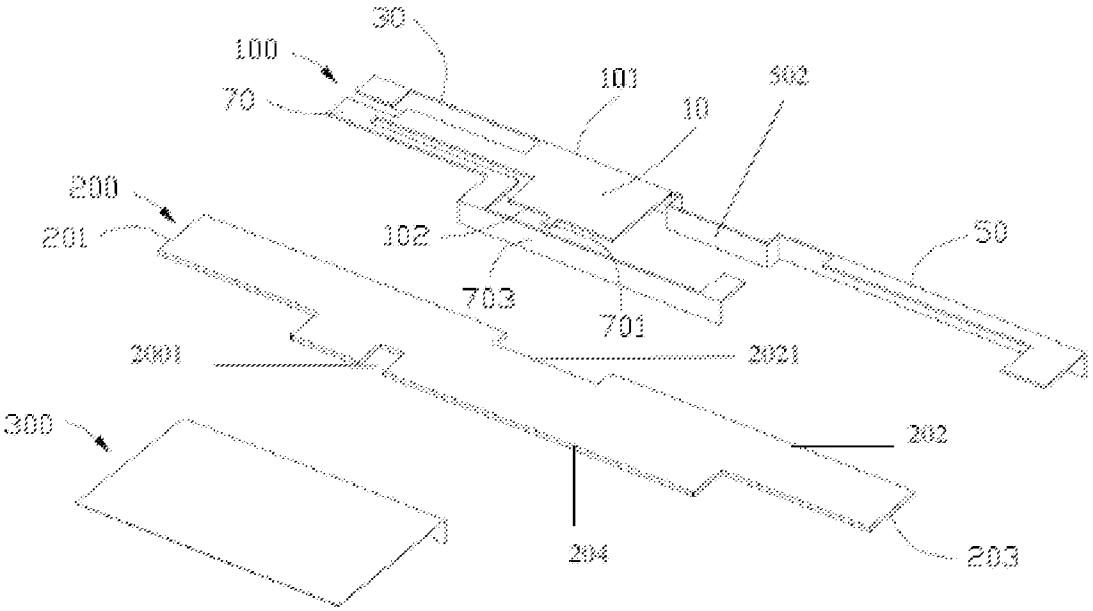
FIG. 1 is a perspective, exploded view of an antenna in accordance with a preferred embodiment of the present disclosure.
Figure 2:
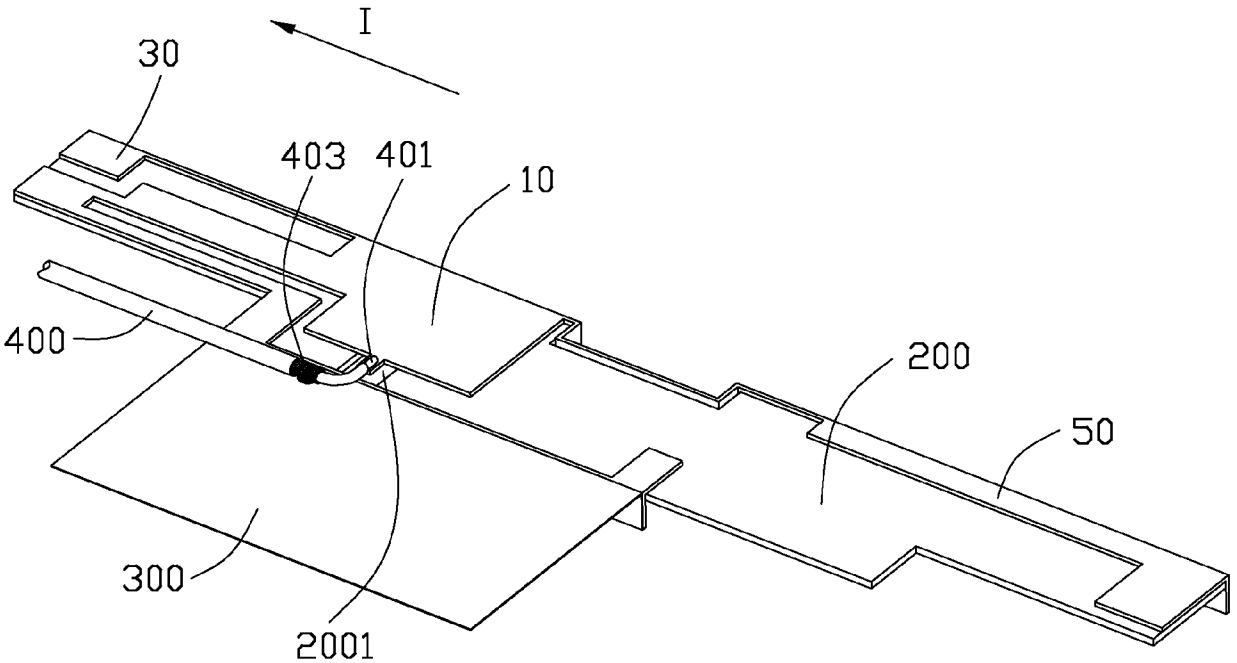
FIG. 2 is a perspective, assembled view of the antenna shown in FIG. 1.

Referring to FIG. 1 and FIG. 2, an antenna 100 in accordance with the preferred embodiment of the present disclosure is assembled on an insulating board 200. The antenna 100 comprises a base section 10 defining a first end 101 and a second end 102 opposite to each other in a transverse direction, a first radiating arm 30 and a second radiating arm 50 extending opposite to each other from the first end 101, and a loop conductive portion 70 adjacent to the second end 102. The insulating board 200 comprises a first side 201 and a second side 203 opposite to each other in a longitudinal direction perpendicular to the transverse direction. The insulating board 200 further comprises a third side 202 and a fourth side 204 opposite to each other in a transverse direction perpendicular to the longitudinal direction, wherein a notch 2021 is formed in the third side 202 and anther notch 2001 is formed in the fourth side 204.

The base section 10 comprises a third end 103 and a fourth end 104 perpendicular to the first and second end 101, 102. The base section 10 is a rectangular plate formed by the first end 101, the third end 103, the second end 102 and the fourth end 104 connecting each other successively. The first radiating arm 30 locates on the third end 103 of the base section 10 and extends towards the first side 201 of the insulating board 200 while the second radiating arm 50 locates on the fourth end 104 of the base section 10 and extends towards the second side 203 of the insulating board 200. The first radiating arm 30 is shorter than the second radiating arm 50.

Figure 4:
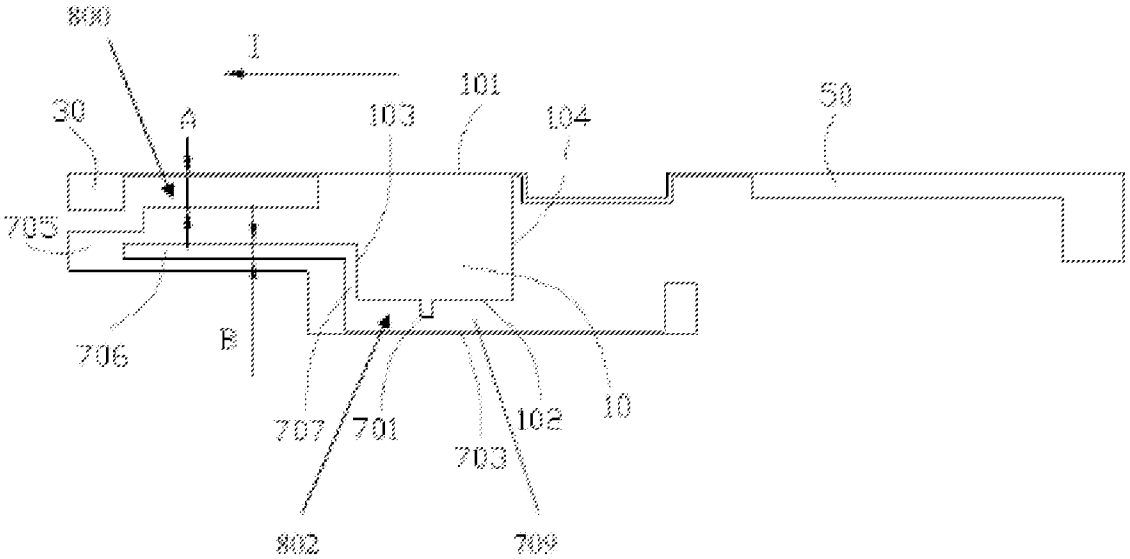
FIG. 4 is a top view of the antenna.

Referring to FIG. 4, the loop conductive portion 70 comprises a feed point portion 701 extending from the second end 102 of the base section 10, a grounding portion 703 parallel to the second end 102 and adjacent to the feed point portion 701, and a connecting portion 705 connecting the feed point portion 701 and the grounding portion 703. The connecting portion 705 firstly extends from the third end 103 of the base section 10 towards the first side 201 of the insulating board 200 and then extends backwardly towards the base section 10 in the longitudinal direction, and finally extends downwardly in the transverse direction connecting the grounding portion 703. The loop conductive portion 70 forms a main matching slot 706 and a secondary matching slot 707 beside the third end 103. The main matching slot 706 extends in the longitudinal direction while the secondary matching slot 707 extends in the transverse direction perpendicular to the longitudinal direction forming an L-shaped structure. Another slot 709, into which the feed point portion 701 extends, is formed between the second end 102 and the grounding portion 703 so as to cooperate with the main matching slot 706 and the secondary matching slot 707 to commonly form a lower upstanding Z-shaped slot 802. The feed point portion 701 is aligned within a notch 2001 in a direction perpendicular to a plane defined by the base section 10. The connecting portion 705 together with the first radiating arm 30 defines a gap, the width A of the gap is between one and four times the width B of the main matching slot 706. An upper upstanding Z-shaped slot 800 is formed between the connecting portion 705 and the first radiating arm 30 with one end confronting the base section 10 and the other end communicating with an exterior.

Referring to FIG. 2, in order to strength the grounding effect, a metal foil 300 is pasted on the grounding portion 703. A coaxial cable 400 connects the antenna 100. The coaxial cable 400 comprises an inner conductor 401 connecting the feed point portion 701 and an outer conductor 403 connecting the metal foil 300.

Figure 3:
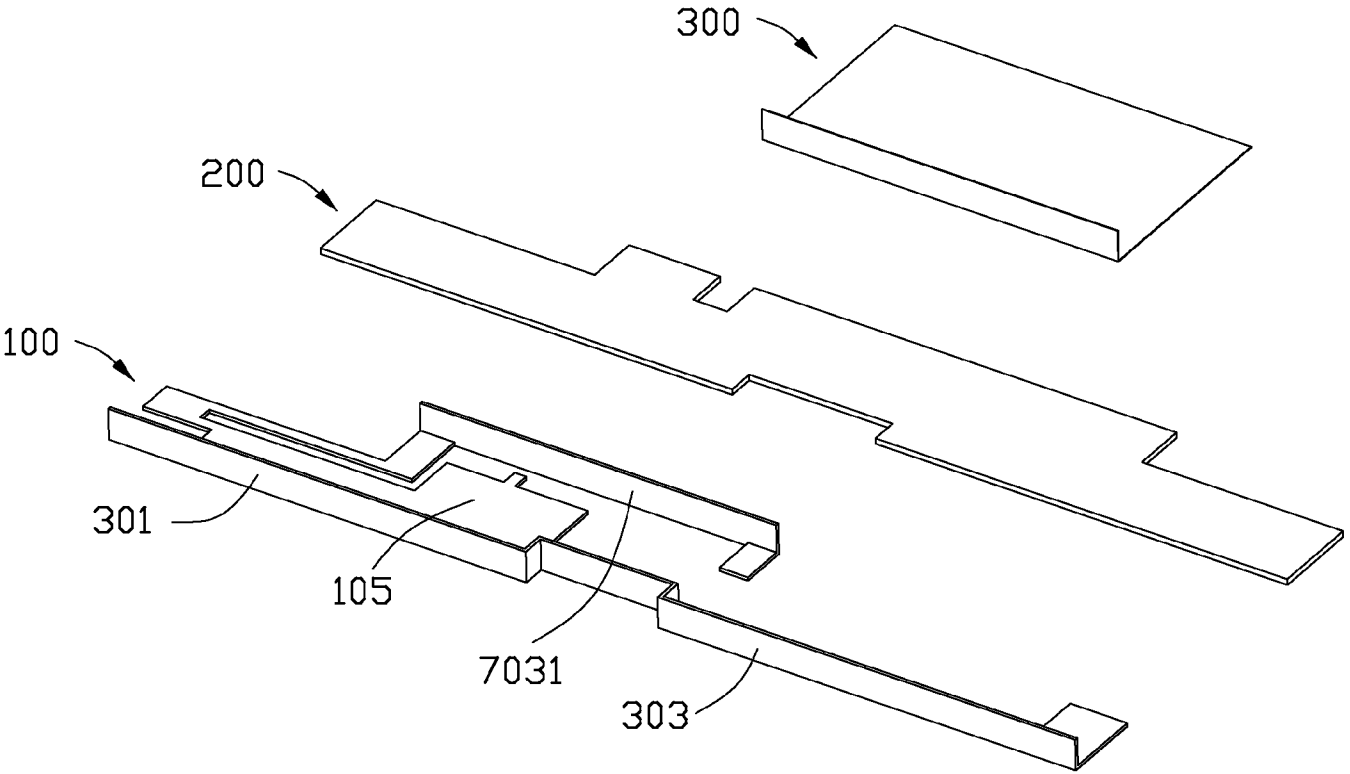
FIG. 3 is another perspective, exploded view of the antenna shown in FIG. 1.

Referring to FIG. 3 and FIG. 4, in the preferred embodiment of the present disclosure, the antenna 100 is stamped and bent from a metal plate. The base section 10 locates on a first plane 105. The grounding portion 703 defines a second plane 7031 perpendicular to the first plane 105. The main matching slot 706 and the secondary matching slot 707 locate on the first plane 105. The first radiating arm 30 defines a third plane 301 while the second radiating arm 50 defines a fourth plane 303. The third plane 301 and the fourth plane 303 are perpendicular to the first plane 105 and parallel to the second plane 7031. The second radiating arm 50 further forms a U-shaped structure 502 located beside the fourth plane 303 and compliantly received within the notch 2021. The base section 10 locates between the third plane 303 and the second plane 7031. In the embodiment of the present disclosure, the third and fourth planes 301, 303 are coplanar. The first radiating arm 30 and/or the second radiating arm 50 define a portion located in the first plane 105 at the free end thereof. The first radiating arm 30 works on 1710~2700 MHz while the second radiating arm 50 works on 704~960 MHz. This structure of the antenna can meet the frequency bands requirements of both 3G and LTE.

While preferred embodiment in accordance with the present disclosure has been shown and described, equivalent modifications and changes known to persons skilled in the art according to the spirit of the present disclosure are considered within the scope of the present disclosure as defined in the appended claims.

What is claimed is:

1. A multi-band antenna assembly comprising:

an antenna including:

a metallic base section extending in a first plane;

at least a radiating arm linked at an upper side of the base section;

a loop conductive portion defining unitarily a grounding portion and a connecting portion, said connecting portion linked to a first lateral side of the base section in said first plane;

a first upstanding Z-shaped slot formed between the base section and the loop conductive portion and lying in said first plane and laterally communicating with an exterior on a second lateral side of the base section opposite to said first lateral side; and a coaxial cable including an inner conductor linked to a bottom side of the base section adjacent to the slot, and an outer conductor linked to a position adjacent to the grounding portion.

2. The multi-band antenna assembly as claimed in claim 1, wherein the connecting portion defines a lying Z-shaped configuration in said first plane beside said standing Z-shaped slot.

3. The multi-band antenna assembly as claimed in claim 1, wherein a second upstanding Z-shaped slot is formed beside the base section and located in said first plane above said first standing Z-shaped slot and laterally communicating with the exterior at the first lateral side of the base section.

4. The multi-band antenna assembly as claimed in claim 1, wherein said grounding portion is located adjacent to a lower side of the base second and lies in a second plane perpendicular to said first plane.

5. The multi-band antenna assembly as claimed in claim 4, further including a metallic foil linked to the grounding portion and extending primarily coplanar with the first plane, wherein the outer conductor of the coaxial cable is connected to said metallic foil.

6. The multi-band antenna assembly as claimed in claim 4, further including an insulative plate lying in a third plane intimately behind the first plane in a parallel relation to support the antenna, wherein the grounding portion abuts against a longitudinal edge of said insulative plate via assistance of said connecting portion at one end and an independent tab at the other end in a longitudinal direction.

7. The multi-band antenna assembly as claimed in claim 3, wherein said second upstanding Z-shaped slot is formed between the connecting portion and the radiating arm which is opposite to the grounding portion.

8. The multi-band antenna assembly as claimed in claim 3, wherein said base section forms a feed point portion extending into the Z-shaped slot and toward the grounding portion.

9. The multi-band antenna assembly as claimed in claim 6, wherein said base section forms a feed point portion extending into the Z-shaped slot and toward the grounding portion, and said feed point portion is aligned with a notch in said insulative plate along a direction perpendicular to said first plane.

10. A multi-band antenna assembly comprising:

an antenna including:

a metallic base section extending in a first plane;

at least a radiating arm linked at an upper side of the base section;

a loop conductive portion defining unitarily a grounding portion located around and spaced from a lower side of the base section, and a connecting portion, said connecting portion unitarily and laterally extending from a first lateral side of the base section in said first plane; wherein an upstanding Z-shaped slot is formed between the connecting portion and the radiating arm and beside the base section in said first plane; wherein the upstanding Z-shaped slot includes an inner end blocked by the base section and an outer end laterally communicating with the exterior on the first lateral side of the base section.

11. The multi-band antenna assembly as claimed in claim 10, further including another upstanding Z-shaped slot formed among the base section, the connecting portion and the grounding portion in the first plane below said upstanding Z-shapes slot laterally communicating with the exterior on the second lateral side of the base section.

12. The multi-band antenna assembly as claimed in claim 11, further including an insulative plate supporting both the base section and the loop conductive portion in a direction perpendicular to the first plane, wherein the insulative plate forms a notch and the base section forms a feed point portion extending into said another upstanding Z-shaped slot and aligned with a notch in the insulative plate in said direction.

* * * * *